US011643811B2

(12) United States Patent
Fest

(10) Patent No.: US 11,643,811 B2
(45) Date of Patent: May 9, 2023

(54) ACOUSTIC PANEL AND SYSTEM

(71) Applicant: Corsair Memory, Inc., Fremont, CA (US)

(72) Inventor: Julian Fest, Munich (DE)

(73) Assignee: Corsair Memory, Inc., Fremont, CA (US)

( * ) Notice: Subject to any disclaimer, the term of this patent is extended or adjusted under 35 U.S.C. 154(b) by 311 days.

(21) Appl. No.: 17/122,267

(22) Filed: Dec. 15, 2020

(65) Prior Publication Data

US 2021/0404178 A1 Dec. 30, 2021

(30) Foreign Application Priority Data

Jun. 26, 2020 (EP) ..... 20182676

(51) Int. Cl.
*E04B 1/86* (2006.01)
*E04B 1/84* (2006.01)
*E04B 1/82* (2006.01)

(52) U.S. Cl.
CPC ..... *E04B 1/86* (2013.01); *E04B 2001/8281* (2013.01); *E04B 2001/8414* (2013.01);
(Continued)

(58) Field of Classification Search
CPC ..... E04B 1/86; E04B 1/84; E04B 1/82; E04B 2001/8281; E04B 2001/8263; E04B 2001/8414; E04B 2001/8452; E04B 2001/8423; E04B 2001/8442; E04B 2001/8461; E04B 2001/8457
See application file for complete search history.

(56) References Cited

U.S. PATENT DOCUMENTS 4,122,915 A * 10/1978 Taguchi ..... G10K 11/16 428/33
4,423,573 A * 1/1984 Omholt ..... E04B 1/8227 52/489.1
(Continued)

FOREIGN PATENT DOCUMENTS

DE 10051658 C1 * 2/2002 ..... E04B 1/8218
EP 1612340 A1 * 1/2006 ..... E04B 1/8227
(Continued)

OTHER PUBLICATIONS

Extended European Search Report from corresponding European Patent Application No. 20182676.5, dated Feb. 15, 2021.
(Continued)

*Primary Examiner* — Edgardo San Martin
(74) *Attorney, Agent, or Firm* — Harness, Dickey & Pierce, P.L.C.

(57) ABSTRACT

An acoustic panel comprises a mounting element and an acoustic damping element. The mounting element is adapted to be mounted to a wall or another structure of a building, and comprises a plurality of protrusions extending from a front side of the mounting element. The acoustic damping element comprises a rear face with a plurality of openings, and is adapted to be mounted to the mounting element with the plurality of protrusions fitting into the plurality of openings to hold the acoustic damping element in place at the mounting element. An acoustic panel system comprises a plurality of acoustic panels and a plurality of connecting brackets.

18 Claims, 13 Drawing Sheets

(52) U.S. Cl.
CPC ..... *E04B 2001/8452* (2013.01); *E04B 2001/8461* (2013.01)

(56) References Cited

U.S. PATENT DOCUMENTS

| | | | | |
|---|---|---|---|---|
| 4,702,046 | A | 10/1987 | Haugen et al. | |
| 4,971,850 | A | 11/1990 | Kuan-Hong | |
| 8,967,823 | B2 * | 3/2015 | D'Antonio | F21V 21/04 362/147 |
| 9,328,518 | B2 * | 5/2016 | Bilge | E04F 13/12 |
| 9,702,143 | B2 * | 7/2017 | Perez | E04B 1/86 |
| 10,900,222 | B2 * | 1/2021 | Smith | E04B 1/86 |
| 10,961,700 | B2 * | 3/2021 | Udagawa | E04B 1/86 |
| 11,158,298 | B1 * | 10/2021 | Sutherland, Jr. | G10K 11/002 |
| D943,390 | S * | 2/2022 | Fest | D8/349 |
| D943,391 | S * | 2/2022 | Fest | D8/349 |
| D943,782 | S * | 2/2022 | Fest | D25/163 |
| D943,785 | S * | 2/2022 | Fest | D25/163 |
| 2014/0262607 | A1 | 9/2014 | Gray | |
| 2018/0328036 | A1 * | 11/2018 | Kolcun | B32B 13/045 |
| 2019/0127972 | A1 * | 5/2019 | Mackett | E04B 1/86 |
| 2021/0404178 | A1 * | 12/2021 | Fest | E04B 1/86 |

FOREIGN PATENT DOCUMENTS

| | | | | |
|---|---|---|---|---|
| FR | 3014236 | A1 * | 6/2015 | E04B 1/99 |
| GB | 2531482 | A * | 4/2016 | E04B 1/8409 |
| KR | 100670907 | B1 * | 1/2007 | E04B 1/86 |
| KR | 100930498 | B1 * | 12/2009 | |
| KR | 101023525 | B1 * | 3/2011 | |
| KR | 20160030707 | A * | 3/2016 | E04B 1/86 |
| KR | 20160002430 | U * | 7/2016 | E04B 1/86 |
| KR | 101671801 | B1 * | 11/2016 | E04B 1/82 |
| KR | 2019-0007939 | A | 1/2019 | |
| KR | 20190001562 | U * | 6/2019 | E04B 1/86 |
| WO | WO-2013169788 | A2 * | 11/2013 | E04B 1/86 |

OTHER PUBLICATIONS

Partial European Search Report, dated Nov. 13, 2020, issued in European Patent Application No. EP 20182676.5.

* cited by examiner

ACOUSTIC PANEL AND SYSTEM

CROSS-REFERENCE TO RELATED APPLICATIONS

The present application claims the benefit of European Patent Application Serial No. 20182676.5 filed Jun. 26, 2020 and entitled "ACOUSTIC PANEL AND SYSTEM", which is hereby incorporated by reference in its entirety.

FIELD

The present disclosure relates to the field of acoustic panels for modifying the acoustic properties of a room or building.

BACKGROUND

Since the advent of sound recording, numerous solutions have been proposed for modifying the acoustic properties of a venue of the recording. In particular, it is usually desirable to dampen acoustic reflections at walls or other elements of a room in which the recording takes place. Many of the proposed solutions are directed to recording studios or other professional venues in which relatively complex constructions and relatively high costs can be tolerated.

However, in recent years there has been increasing interest in sound recordings in a personal or semi-professional setting. This not only concerns music production using inexpensive computer programs, but also the recording of videos to be published on video platforms such as YouTube® or social media platforms such as Facebook® or Twitter®. Another growing field concerns computer gaming, namely both the creation of gameplay videos and the participation in online computer games. In both cases, the gamer would like his or her voice to be clearly audible for viewers of the gameplay video or other participants of the online game even in the presence of loud background noise from the game or other sources. Most recently, an increased interest in video conferencing and teleworking has created a need for an acoustically optimized environment at home or in a general office setting.

For all of the above applications, questions of cost and ease of installation are more important than they are in professional studio settings. Good acoustic properties also continue to be an objective. Consequently, a need exists to provide an acoustic panel and an acoustic panel system which are relatively inexpensive and/or which are relatively easy to install.

U.S. Pat. No. 4,702,046 discloses an acoustic wall panel which is mounted to a wall or similar surface using a mounting frame. The panel includes a wooden support frame, low density fiberglass batts positioned within the support frame, and a generally rigid acoustic board positioned in front of an against the frame. The mounting frame and support frame include fastening elements, such as hook and loop fastener strips, which mate and detachably hold together.

SUMMARY

A first aspect of the invention provides an acoustic panel, which comprises a mounting element and an acoustic damping element. The mounting element is adapted to be mounted to a wall or another structure of a building with a rear side of the mounting element towards the wall or other structure of the building. The mounting element comprises a plurality of protrusions extending from a front side of the mounting element. The acoustic damping element comprises a plurality of openings at a rear face of the acoustic damping element. The acoustic damping element is adapted to be mounted to the mounting element with the plurality of protrusions fitting into the plurality of openings to hold the acoustic damping element in place at the mounting element. This construction can be relatively inexpensive to produce and/or relatively easy to install in various settings.

A second aspect of the invention provides an acoustic panel system comprising a plurality of acoustic panels and a plurality of connecting brackets. Each acoustic panel comprises a mounting element and an acoustic damping element adapted to be mounted to the mounting element. Each mounting element comprises a plurality of connecting slots so that a first mounting element adjacent to a second mounting element are connectable to each other by means of a connecting bracket inserted into a first connecting slot of the first mounting element and a second connecting slot of the second mounting element. This construction facilitates the installation of acoustic panel systems to a wall or another building structure.

The present invention is not limited to the field of sound recordings, but can be used whenever it is desired to mount acoustic damping elements to a wall or another structure of a building, both in private and in commercial settings. As non-limiting examples, the present invention may be used to improve the acoustic properties of private or commercial television rooms, cinemas, computer gaming environments, videoconferencing rooms, audiophile music playback rooms, concert and performance environments, ballet, yoga and mediation studios, and so on.

BRIEF DESCRIPTION OF THE DRAWINGS

Further features, objects and advantages of the invention will become apparent from the following detailed description, in connection with the annexed schematic drawings, in which.

DETAILED DESCRIPTION

As shown in FIG. 1 through FIG. 9, an embodiment of the present invention provides an acoustic panel 10 having a mounting element 12 and an acoustic damping element 14. The mounting element 12 and the acoustic damping element 14 each have a generally hexagonal shape. However, other embodiments are envisaged in which the mounting element 12 and the acoustic damping element 14 have other shapes, such as a square or rectangular or circular shape, or a shape formed by three or four connected squares.

Figure 1:
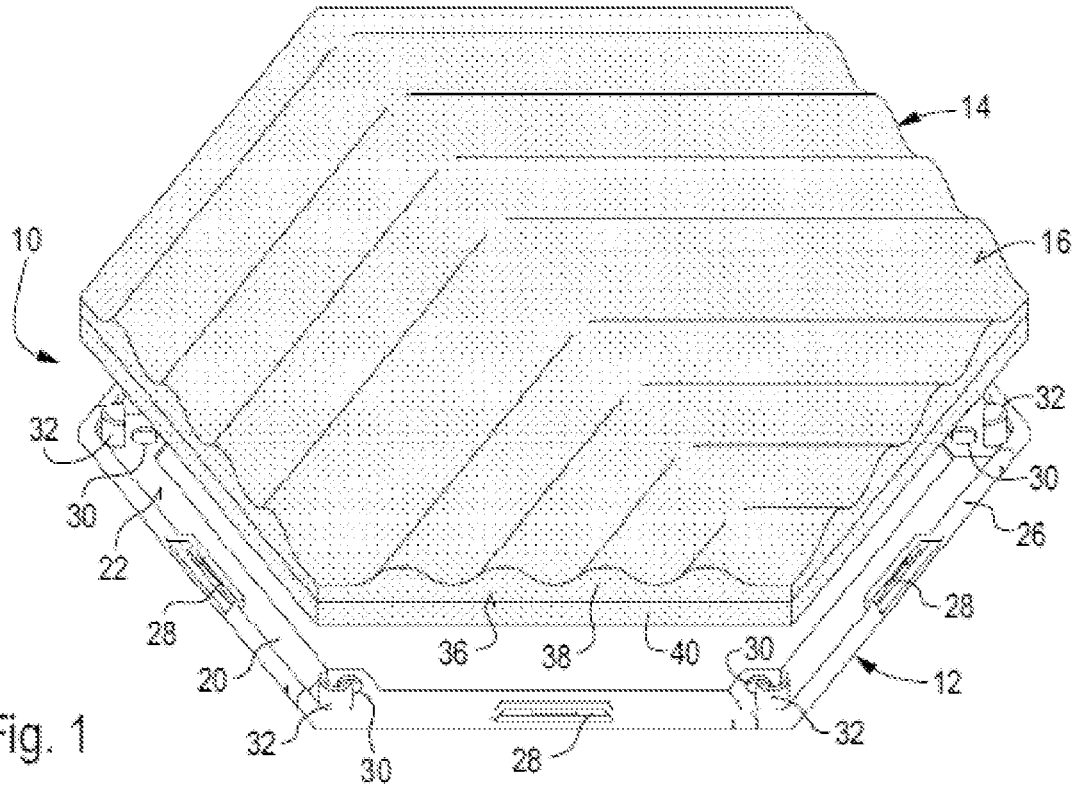
FIG. 1 shows a perspective front and side view of an acoustic panel with drawn-apart elements, according to an embodiment.
Figure 2:
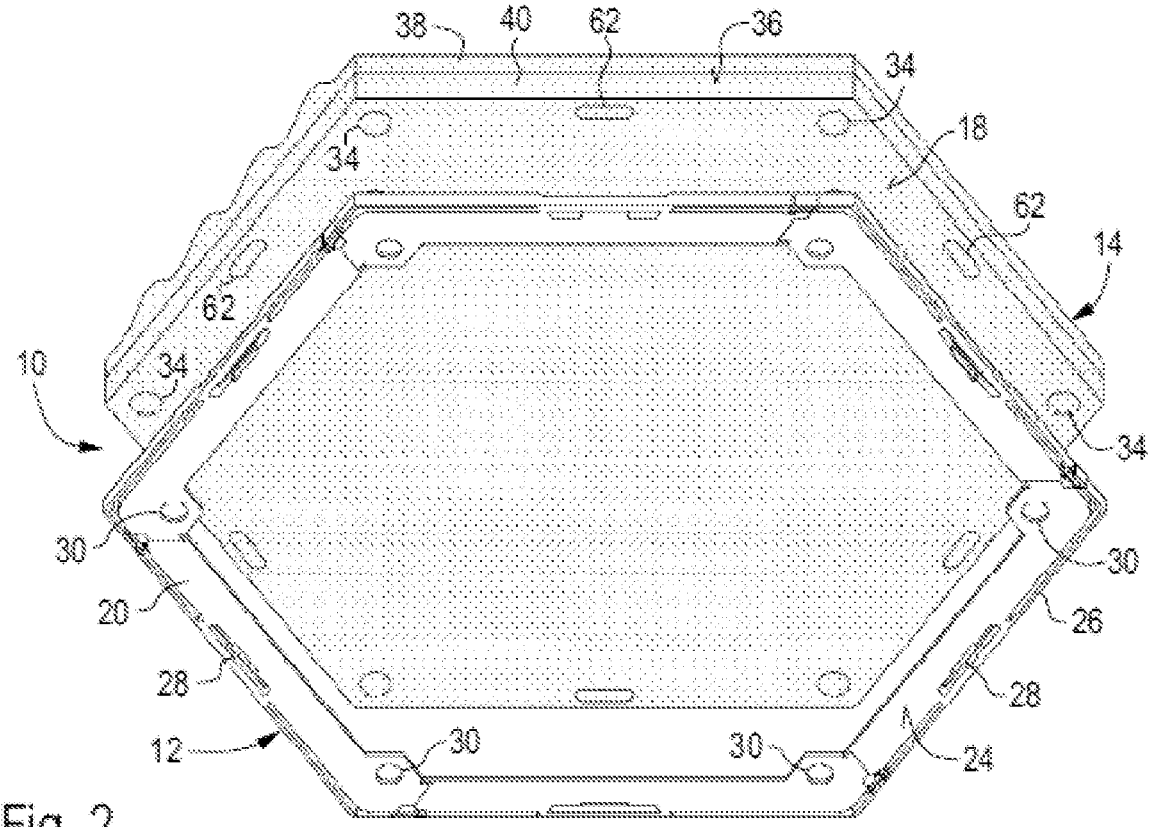
FIG. 2 shows a perspective rear and side view of the acoustic panel of FIG. 1.
Figure 3:
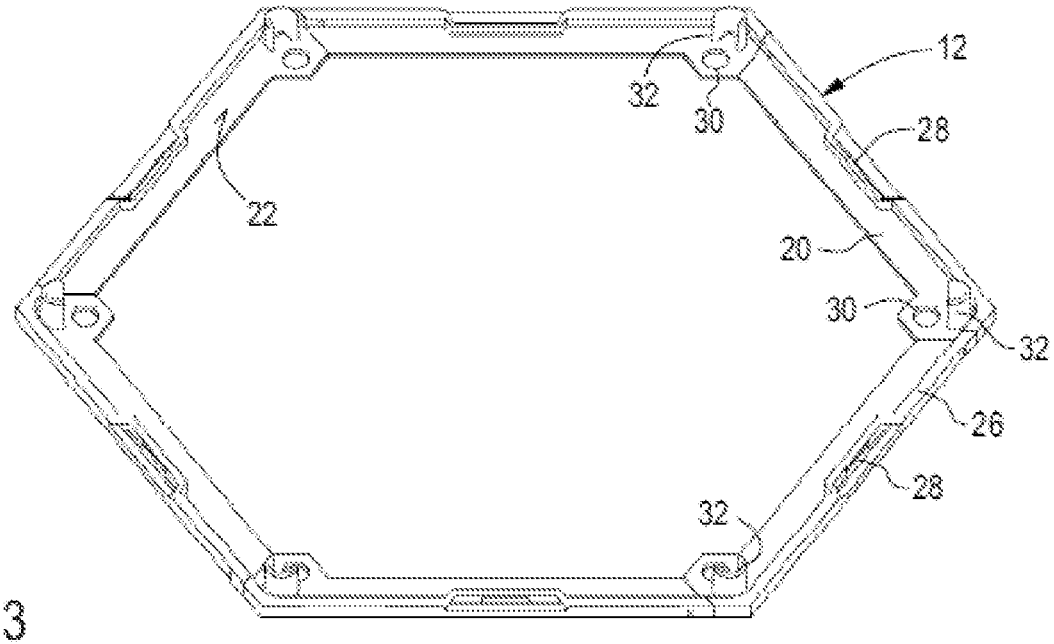
FIG. 3 shows a perspective front and side view of a mounting element that is part of the acoustic panel according to the embodiment shown in FIG. 1.
Figure 4:
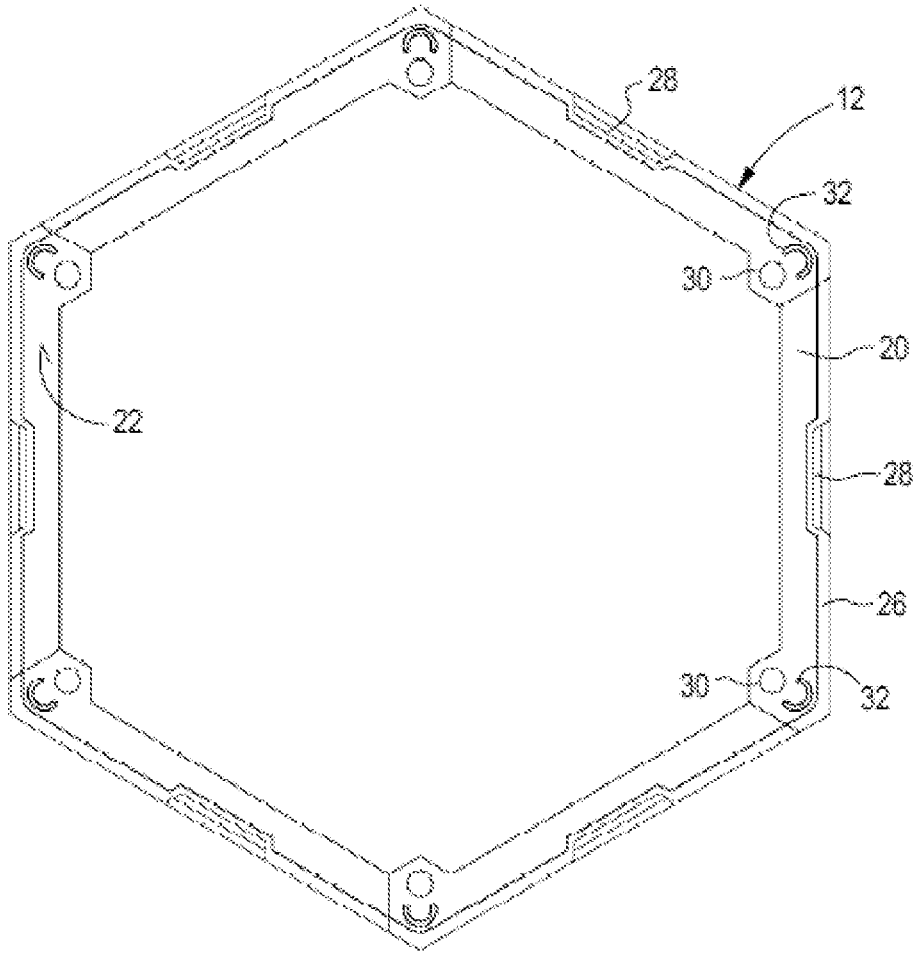
FIG. 4 shows a front view of the mounting element of FIG. 3.
Figure 5:
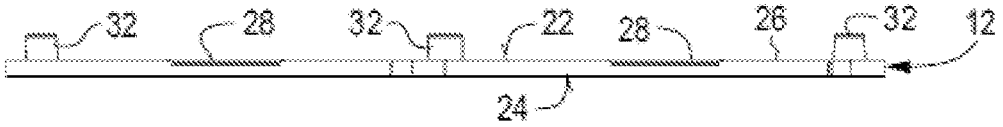
FIG. 5 shows a side view of the mounting element of FIG. 3.
Figure 6:
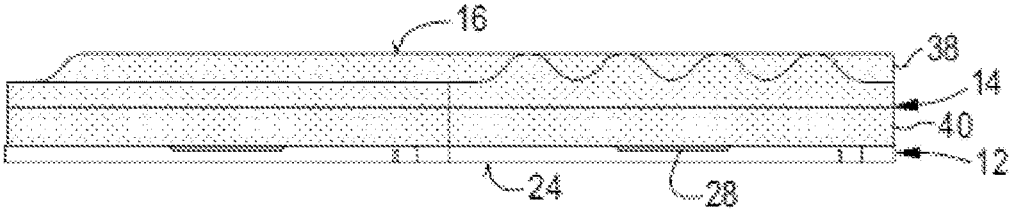
FIG. 6 shows a side view of an acoustic panel comprising the mounting element of FIG. 3.
Figure 7:
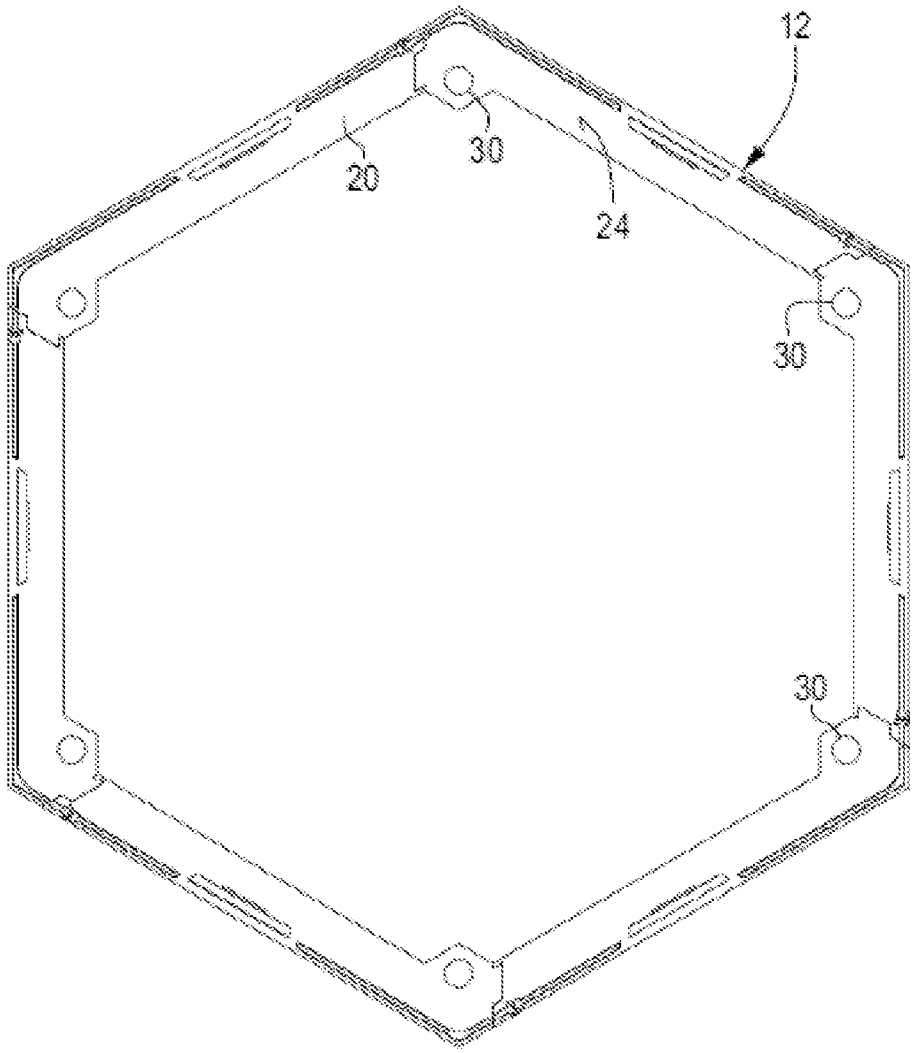
FIG. 7 shows a back view of the mounting element of FIG. 3.

In the presently described embodiment, the mounting element 12 and the acoustic damping element 14 have essentially identical outer contours in plan view. Thus, when the mounted acoustic panel 10 is viewed at its front side, only a front face 16 of the acoustic damping element 14 is visible. In other words, the acoustic damping element 14 completely covers the mounting element 12 when the acoustic panel 10 is viewed at its front side. In the presently described embodiment, as shown in FIG. 6, the sides of the mounting element 12 are visible when the acoustic panel 10 is viewed from the side, but embodiments are also contemplated in which the acoustic damping element 14 has a larger lateral extension than the mounting element 12 so that the acoustic damping element 14 also covers the sides of the mounting element 12.

In the presently described embodiment, the mounting element 12 has essentially the form of a hexagonal frame 20 with a front side 22 and a rear side 24. When the acoustic panel 10 is mounted to a wall or another structure of a building, the rear side 24 contacts the wall or other building structure, and the front side 22 of the mounting element contacts a rear face 18 of the acoustic damping element. In some embodiments, the frame 20 may surround a large central opening at which the rear face 18 of the acoustic damping element 14 faces, but is spaced apart from, the wall or other building structure to which the acoustic panel 10 is mounted. In other words, the frame 20 acts as a spacer which prevents the rear face 18 of the acoustic damping element 14 from touching the wall or other building structure.

The distance between the rear face 18 and the wall or other building structure is determined by the thickness of the portions of the frame 20 against which the acoustic damping element 14 rests. This distance may be, as non-limiting examples, in the range of 2 mm-20 mm, or in the range of 5 mm-10 mm. The central opening may comprise, as non-limiting examples, at least 50% of the area of the rear face 18, or at least 70%, or at least 90%. This arrangement may improve the acoustic absorption properties of the acoustic panel 10 and/or may prevent an undesirable accumulation of moisture at the wall or other building structure behind the mounted acoustic panel 10.

In the presently described embodiment, the mounting element 12 further comprises an outer rim 26, a plurality of connecting slots 28, a plurality of mounting holes 30, and a plurality of protrusions 32.

The outer rim 26 generally increases the stability of the mounting element 12 so that the mounting element 12 can be formed of relatively thin plastic material. The outer rim 26 further provides the necessary structure against which the connecting slots 28, which will be explained below in further detail, can be formed. Yet further, in some embodiments the outer rim 26 assists in holding the acoustic damping element 14 to the mounting element 12. However, in the presently described embodiment the outer rim 26 generally has a smaller height than the protrusions 32 and therefore is less effective than the protrusions 32 for holding the acoustic damping element 14 to the mounting element 12.

The mounting holes 30 enable the mounting element 12 to be fixed to the wall or other building structure by means of screws. In the presently described embodiment, the rear side 24 of the mounting element 12 is configured substantially flat, so that the mounting element 12 can also be fixed to the wall or other building structure by means of double-sided adhesive tape. These two mounting options allow the acoustic panel 10 to be used in a variety of settings.

The protrusions 32 extend from the front side 22 of the mounting element 12 in a direction towards and into the acoustic damping element 14. More specifically, when the acoustic damping element 14 is mounted the mounting element 12 (as shown in FIG. 6), each protrusion 32 fits snugly into a respective opening 34 formed in the rear face 18 of the acoustic damping element 14. The engagement of the protrusions 32 with the openings 34 and the frictional connection between outer side walls of the protrusions 32 and inner side walls of the openings 34 hold the acoustic damping element 14 securely in place at the mounting element 12, especially if the acoustic panel 10 is vertically mounted to a wall. The openings 34 are separate from side faces 36 of the acoustic damping element 14 which extend between, and connect, the front face 16 and the rear face 18 of the acoustic damping element 14. In other words, the openings 34 are not merely parts of, or recesses in, the side faces 36.

For the use case of an acoustic panel 10 that is vertically mounted to a wall, embodiments in which the outer side walls of the protrusions 32 and inner side walls of the openings 34 extend substantially perpendicular to the rear side 24 of the mounting element 12 and/or the rear face 18 of the acoustic damping element 14 may be particularly easy to manufacture. However, embodiments are also contemplated in which the protrusions 32 and/or the openings 34 have cross-sections which vary along the longitudinal extensions of the protrusions 32 and/or the openings 34. For example, if some or all of the protrusions 32 are club-shaped with a small diameter stem section and a large diameter head section, then the engagement of the protrusions 32 in matching openings 34 may be strong enough to enable even an overhead mounting of the acoustic panel 10 at a ceiling of a room.

Each of the protrusions 32 shown in the drawings has the general form of a fin which is curved in a semicircular fashion. However, numerous other forms are contemplated. As non-limiting examples, the protrusions 32 may also be formed as solid or hollow pegs with any kind of cross-sectional shape, such as round, square, rectangular, triangular, hexagonal, or star-shaped. The protrusions 32 may also be formed as straight fins, as relatively narrow pins, or in a variety of other forms. The openings 34 in the acoustic damping element 14 generally have a shape which matches, with a permissible amount of deformation, the shape of the protrusions. The question which amount of deformation is permissible depends on the material of the acoustic damping elements 14 in which the openings 34 are formed. In embodiments which use an easily deformable material, such as a foam or a mat, the shape of the protrusions 32 may be substantially different from the shape of the openings 34 when the mounting element 12 and the acoustic damping element 14 are separate from each other.

The acoustic damping element 14 may generally be formed of any material or materials which has or have the desired acoustic and structural properties. In the presently described embodiment, the acoustic damping element 14 is free from any rigid structural elements. The acoustic damping element 14 may be formed from a single block of suitable material, such as a plastic foam material. However, in the presently described embodiment the acoustic damping element 14 has a front layer 38 and a back layer 40, which are glued or otherwise connected together, durably or removably. Using two layers of different materials allows a wider range of desirable properties to be obtained. Furthermore, if two layers of material are used, the openings 34 do not need to be formed as blind holes, but can simply be punched through the back layer 40 and then covered by the front layer 38.

In the presently described embodiment, the back layer 40 is formed of a non-woven mat of a type which is also used for noise suppression in automotive applications, and the front layer 38 is formed of a noise absorbing plastic foam. However, numerous other materials and combinations of materials can be used. The front face 16 of the acoustic damping element 14 may be formed in a manner which is aesthetically pleasing and/or further improves the acoustic damping properties. In the presently described embodiment, the front face 16 is formed with an undulated surface structure, i.e., in a wave pattern. Numerous other surface structures are envisaged in other embodiments.

The mounting element 12 may be made of any suitable material, such as a relatively rigid plastic material. Manufacturing and transport may be facilitated by forming the mounting element 12 in a number of individual parts, which may be connected or assembled together by the end user. In the presently described embodiment, the mounting element 12 consists of six identical parts 42, each of which comprising one corner and one side of the hexagonal frame 20. The corner portion comprises one mounting hole 30 and one protrusion 32, and the side portion comprises one connecting slot 28 arranged approximately in the middle of the side portion.

Figure 8:
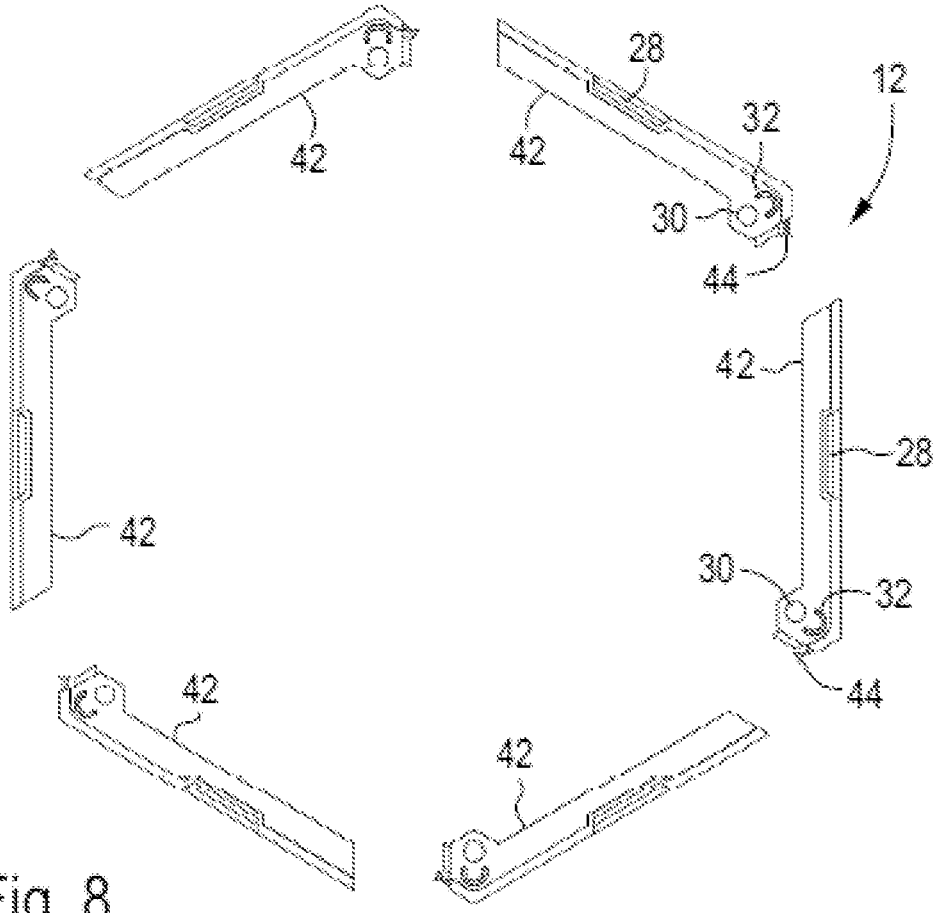
FIG. 8 shows a front view of the mounting element of FIG. 3 with drawn-apart parts.
Figure 9:
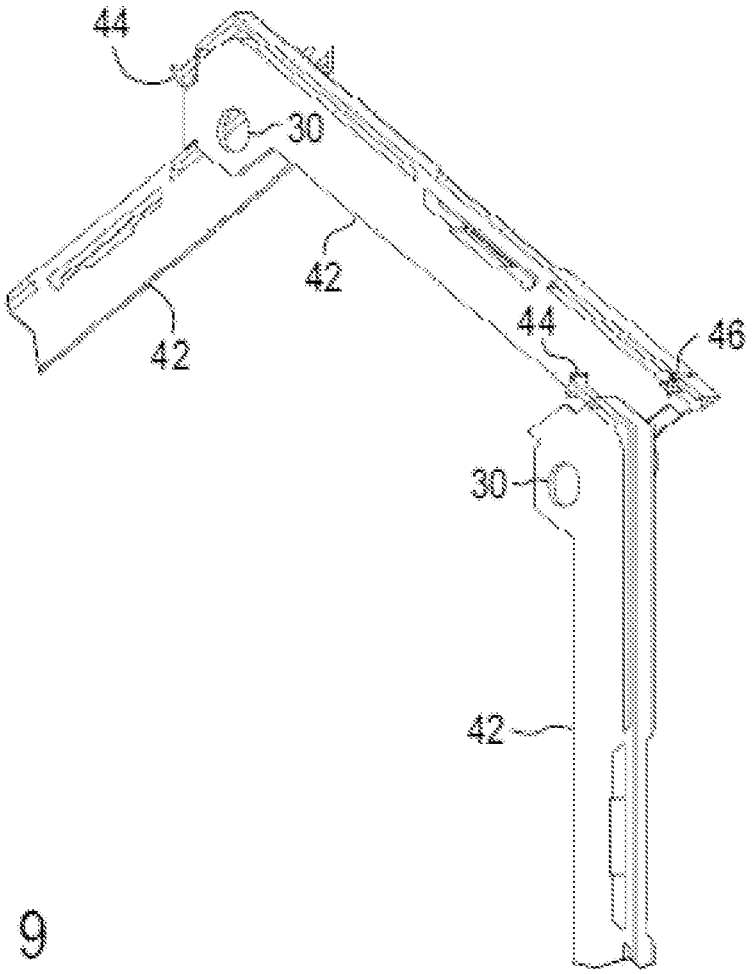
FIG. 9 shows an enlarged perspective view of some of the parts of the mounting element of FIG. 8.

As shown in FIG. 8 and FIG. 9, the parts 42 may be plugged together, without using any tools, to form the hexagonal frame 20. Each of the parts 42 comprises a mushroom-shaped locking element 44 which engages with a matching recess 46 in the outer rim 26 of an adjacent part 42 to lock two of the parts 42 securely together.

Figure 12:
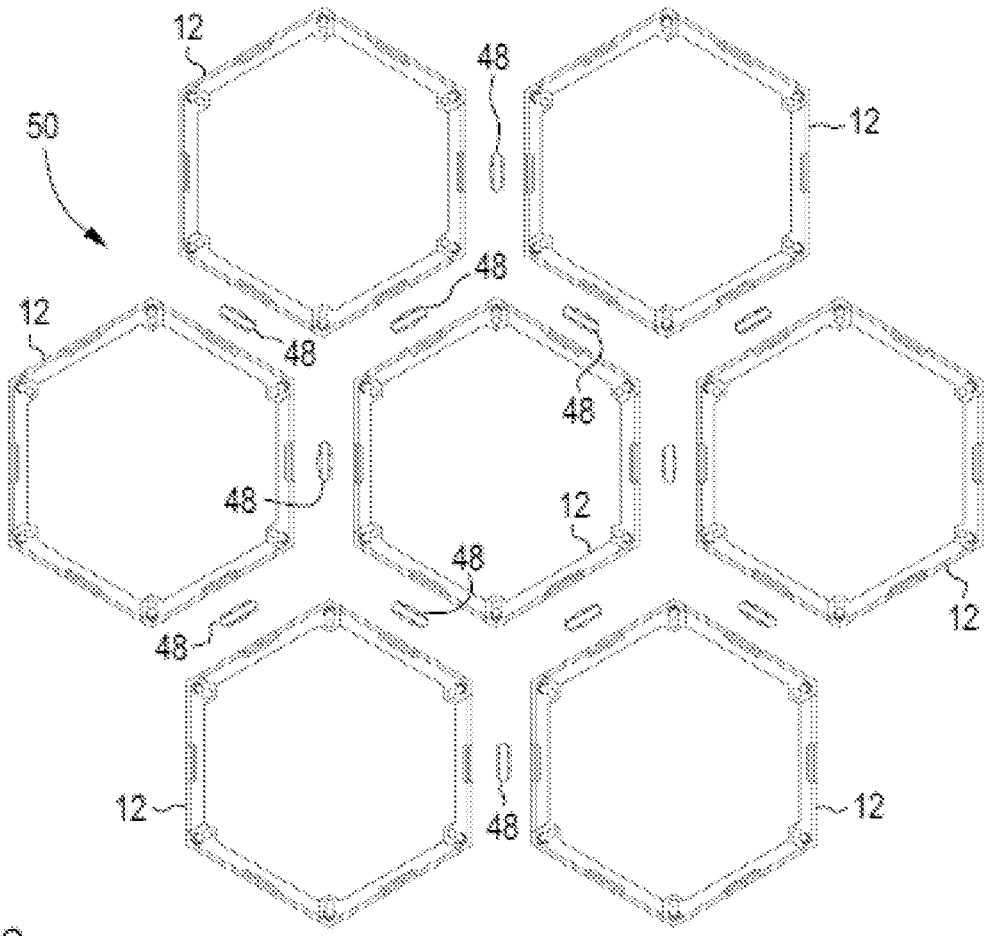
FIG. 12 shows a drawn-apart front view of seven mounting elements and twelve mounting brackets of an acoustic panel system.
Figure 13:
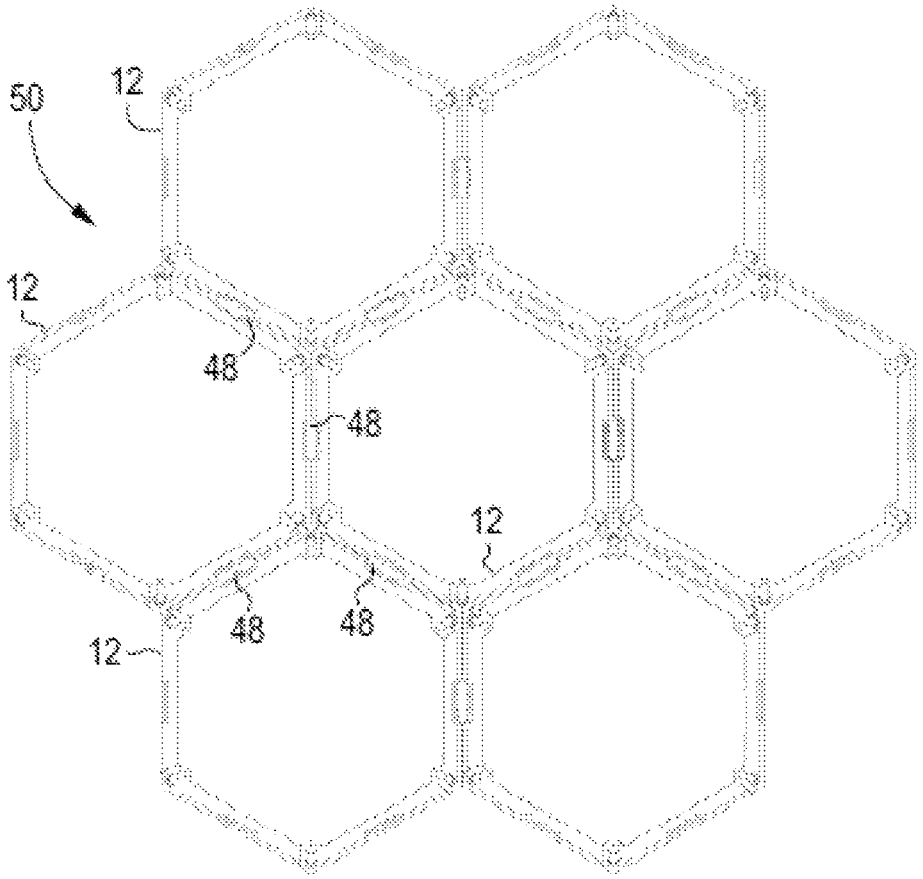
FIG. 13 shows a front view of the mounting elements and mounting brackets of FIG. 12 connected to each other.
Figure 14:
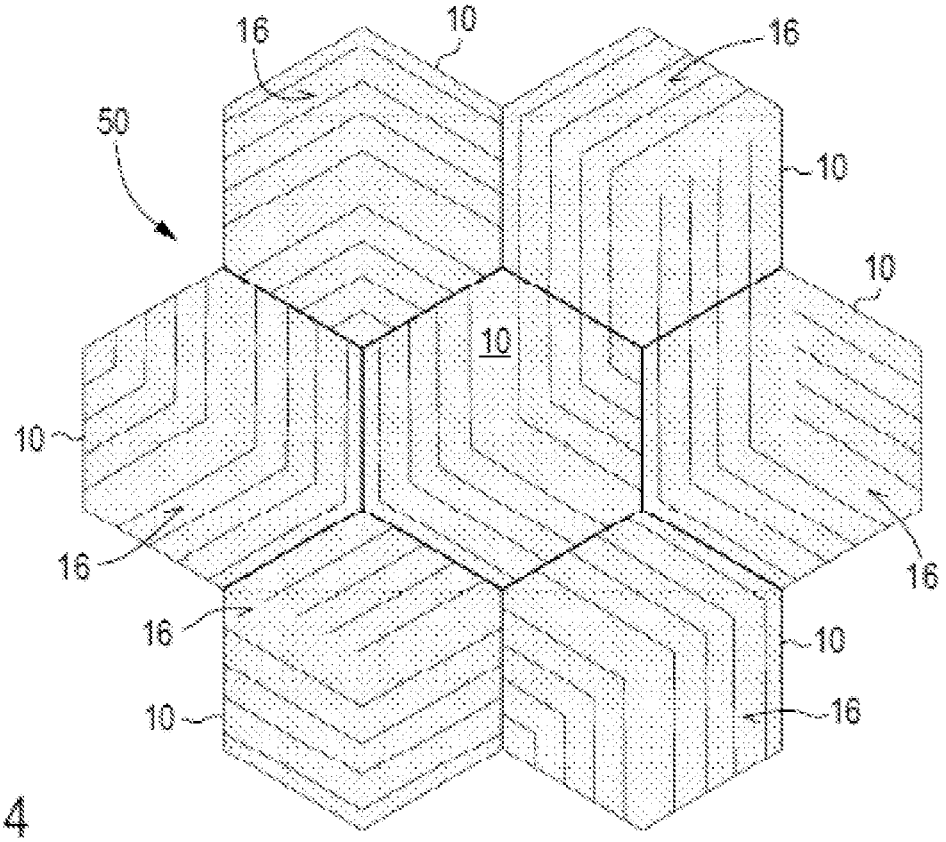
FIG. 14 shows a front view of an acoustic panel system comprising seven acoustic panels.

The presently described embodiment further allows a plurality of mounting elements 12 to be linked together by means of connecting brackets 48. This has the advantages that proper alignment of the mounting elements 12 with each other is facilitated, and/or that not all of the mounting elements 12 need to be fixed to the wall or other building structure. For example, in an acoustic panel system 50 shown in FIG. 12 through FIG. 14, it may be sufficient to fix only the middle mounting element 12 to the wall or other building structure by means of screws or adhesive tape, while the surrounding mounting elements 12 may be held merely by virtue of the connecting brackets 48. This is especially true if the acoustic panel system 50 shown in FIG. 12 through FIG. 14 is part of an even larger installation, such that there will be further fixedly mounted mounting elements 12 surrounding the mounting elements 12 shown. For example, it may be sufficient if less than 50%, or less than 30%, or less than 20%, of the mounting elements 12 are directly fixed to the wall or building structure.

Figure 10:
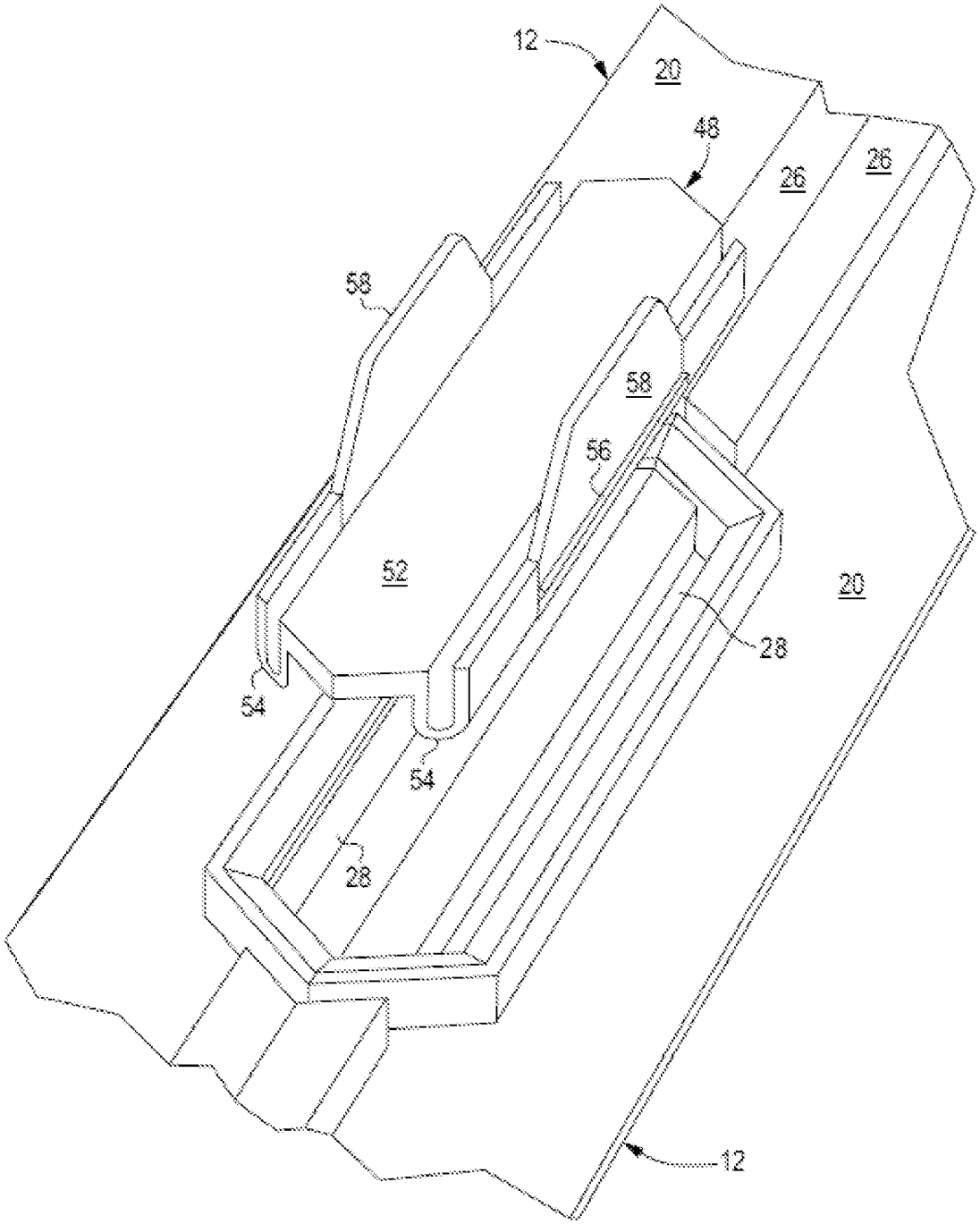
FIG. 10 shows a perspective front and side view of a portion of two adjacent mounting elements and a connecting bracket.
Figure 11:
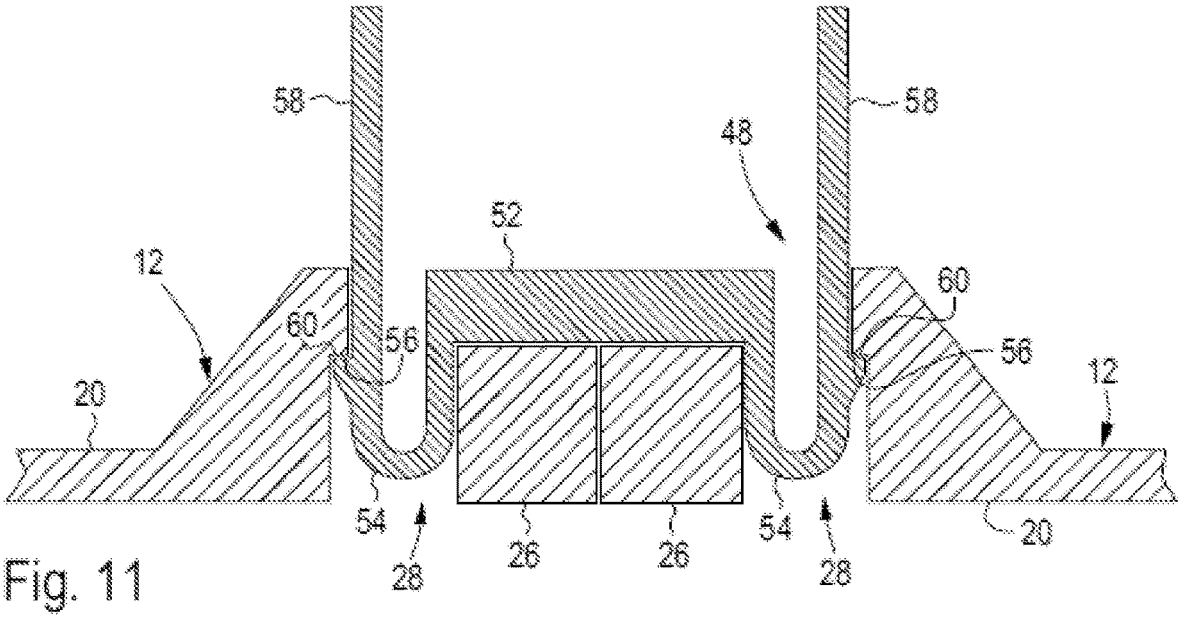
FIG. 11 shows a sectional view though a connecting bracket inserted into connecting slots of two adjacent mounting elements.

As shown in FIG. 10 and FIG. 11, each connecting bracket 48 comprises a bridge portion 52 which connects two insertion portions 54. Each insertion portion 54 has an approximately U-shaped cross-section and fits into a respective connecting slot 28 of a respective mounting element 12. Each insertion portion 54 further has a locking structure 56 in the form of a ridge which normally protrudes beyond an outer arm of the U-shaped insertion portion 54. However, the two locking structures 56 are flexibly arranged and can be moved towards the bridge portion 52 by pressing the two handling portions 58 towards each other. The connecting bracket 48 may be formed from a plastic material which provides the required flexibility.

When the connecting bracket 48 is inserted with its two insertion portions 54 into the respective connecting slots 28 of two adjacent mounting elements 12, as shown in FIG. 11, the two adjacent mounting elements 12 are firmly held together. The locking structures 56 of the insertion portions 54 engage with corresponding locking structures 60 of the connecting slots 28, thus enabling the connecting bracket 48 to snap-in into its locked position. The connecting brackets 48 do not impede the mounting of the acoustic damping elements 14 on the mounting elements 12 because the acoustic damping elements 14 comprise longitudinal slots 62 (shown in FIG. 1 and FIG. 2) which accommodate the handling portions 58 of any inserted connecting brackets 48.

When the user wishes to separate the two adjacent mounting elements 12, he or she presses the two handling portions 58 of the connecting bracket 48 towards each other. This will cause the locking structures 56 of the connecting bracket 48 to disengage from the corresponding locking structures 60 of the connecting slots 28, thus allowing the connecting bracket 48 to be removed and re-used.

The exemplary acoustic panel system 50 shown in FIG. 14 comprises a total of seven acoustic panels 10, but it is apparent that the system 50 can be extended in any desired manner. The undulated front faces 16 of the acoustic damping elements 14 directly abut against each other, without any irritating gaps. The mounting elements 12 are not visible at all in front view. Even if the acoustic panel system 50 is viewed from the side, only the relatively low outer rims 26 of the mounting elements 12 are visible. Because of the hexagonal and rotationally symmetric arrangement of all elements of the acoustic panels 10, each acoustic damping element 14 can be arranged at each mounting element 12 in any of six possible rotational orientations, i.e., at 0°, 60°, 120°, 180°, 240° and 300°. This enables the user to create his or her own patterns on the front faces 16 of the acoustic panel system 50, which can further be changed simply by re-arranging the acoustic damping elements 14 on the mounting elements 12, without any change to the mounting elements 12.

In exemplary and non-limiting embodiments, the dimensions of each acoustic panel 10 may be in the range of 200 mm-1000 mm between two corners, or in the range of 300 mm-800 mm, or in the range of 400 mm-600 mm, or substantially 500 mm, each time between two corners. The overall height of each acoustic panel 10 may be in the range of 20 mm-100 mm between the rear side 24 and the front face 16, or in the range of 30 mm-70 mm, or in the range of 40-50 mm, or substantially 45 mm, each time between the rear side 24 and the front face 16.

The particulars contained in the above description of sample embodiments should not be construed as limitations of the scope of the invention, but rather as exemplifications of some embodiments thereof. Many variations are possible and are immediately apparent to persons skilled in the art. In particular, this concerns variations that comprise a combination of features of the individual embodiments disclosed in the present specification. Accordingly, the scope of the invention should be determined not by the embodiments illustrated, but by the appended claims and their legal equivalents.

LIST OF REFERENCE SIGNS

10 acoustic panel
12 mounting element
14 acoustic damping element
16 front face (of acoustic damping element 14)
18 rear face (of acoustic damping element 16)
20 hexagonal frame
22 front side (of mounting element 12)
24 rear side (of mounting element 12)
26 outer rim
28 connecting slot
30 mounting hole
32 protrusion
34 opening (in acoustic damping element 14)
36 side face (of acoustic damping element 14)
38 front layer (of acoustic damping element 14)
40 back layer (of acoustic damping element 14)
42 part (of mounting element 12)
44 locking element (of part 42)
46 recess (in outer rim 26)
48 connecting bracket
50 acoustic panel system
52 bridge portion (of connecting bracket 48)
54 insertion portion (of connecting bracket 48)
56 locking structure (of connecting bracket 48)
58 handling portion
60 locking structure (of connecting slot 28)
62 longitudinal slot

What is claimed is:

1. An acoustic panel comprising:

a mounting element having a front side and a rear side, wherein the mounting element is adapted to be mounted to a wall or another structure of a building with its rear side towards the wall or other structure of the building, wherein the mounting element comprises a plurality of protrusions extending from the front side of the mounting element, and an outer rim extending from the front side of the mounting element and circumferentially surrounding the plurality of protrusions, and an acoustic damping element having a front face, a rear face and at least one side face extending between the front face and the rear face, wherein the rear face comprises a plurality of openings extending from the rear face to a portion of the acoustic damping element between the front face and the rear face, wherein the outer rim extends along part of the at least one side face of the acoustic damping element when the acoustic damping element is mounted to the mounting element, wherein the acoustic damping element is adapted to be mounted to the mounting element with the plurality of protrusions fitting into the plurality of openings to hold the acoustic damping element in place at the mounting element.

2. The acoustic panel according to claim 1, wherein the acoustic damping element completely covers the mounting element when the front face of the acoustic damping element mounted to the mounting element is viewed in a viewing direction perpendicular to the direction of the rear side of the mounting element.

3. The acoustic panel according to claim 1, wherein the acoustic damping element comprises two layers of material having different acoustic properties, and wherein each layer is formed of a foam or a mat or a fabric.

4. The acoustic panel according to claim 1, wherein at least some openings of the plurality of openings are separate from the at least one side face.

5. The acoustic panel according to claim 1, wherein each of the plurality of protrusions of the mounting element has at least one side wall which extends substantially perpendicular, with a maximum deviation of ±10°, to the rear side of the mounting element, and wherein each of the plurality of openings of the acoustic damping element has at least one side wall which extends substantially perpendicular, with a maximum deviation of ±10°, to the rear face of the acoustic damping element.

6. The acoustic panel according to claim 1, wherein the outer rim has a smaller extension, from the front side of the mounting element in a direction perpendicular to the mounting element, than at least some protrusions of the plurality of protrusions.

7. The acoustic panel according to claim 1, wherein the mounting element extends along a circumferential portion of the rear face of the acoustic damping element when the acoustic damping element is mounted to the mounting element so that the mounting element acts as a spacer which ensures an open space between at least part of the rear face of the acoustic damping element and the wall or other structure of the building when the acoustic panel is mounted to the wall or other structure of the building.

8. The acoustic panel according to claim 1, wherein the mounting element comprises a plurality of identical parts which are adapted to be connected together.

9. The acoustic panel according to claim 1, wherein the mounting element has the shape of a hexagonal frame and comprises six identical parts adapted to be connected together, and wherein each of the six identical parts has a corner section forming one corner of the hexagonal frame and a side section forming one side of the hexagonal frame.

10. An acoustic panel system comprising:

a plurality of acoustic panels and a plurality of connecting brackets, wherein each acoustic panel of the plurality of acoustic panels comprises a mounting element including a plurality of protrusions extending therefrom and an outer rim extending therefrom and circumferentially surrounding the plurality of protrusions, and an acoustic damping element adapted to be mounted to the mounting element, wherein the acoustic damping element includes a front face, an opposing rear face and a plurality of openings configured to receive the plurality of protrusions, wherein the plurality of openings extend from the rear face to a portion of the acoustic damping element between the front face and the rear face, wherein the outer rim extends along part of the acoustic damping element when the acoustic damping element is mounted to the mounting element, wherein each mounting element comprises a plurality of connecting slots so that a first mounting element adjacent to a second mounting element are connectable to each other by means of a connecting bracket inserted into a first connecting slot of the first mounting element and a second connecting slot of the second mounting element.

11. The acoustic panel system of claim 10, wherein each acoustic panel has a hexagonal shape, and wherein each mounting element has the shape of a hexagonal frame and comprises six connecting slots, each arranged at a respective side of the hexagonal frame substantially in the middle between two respective corners.

12. The acoustic panel system of claim 10, wherein each connecting bracket is formed of a plastic material and comprises a bridge portion connecting two insertion portions to be inserted into two respective connecting slots.

13. The acoustic panel system of claim 12, wherein each connecting bracket further comprises a first locking structure arranged at a first one of the two insertion portions and a second locking structure arranged at a second one of the two insertion portions, and wherein each of the first and second locking structures is configured to engage with respective third and fourth locking structures formed in two respective connecting slots.

14. The acoustic panel system of claim 13, wherein each connecting bracket further comprises two handling portions which are adapted to cause, when pressed together, the insertion portions to be moved relative to each other and the first and second locking structures to disengage from the third and fourth locking structures.

15. The acoustic panel according to claim 1, wherein the acoustic damping element includes one or more layers of material free of any rigid structural elements, and wherein each layer is formed of a foam or a mat or a fabric.

16. The acoustic panel according to claim 1, wherein the front face of the acoustic damping element has an undulated surface structure.

17. The acoustic panel according to claim 1, wherein at least one protrusion of the plurality of protrusions is one of a peg, a pin, a curved fin, and a straight fin.

18. The acoustic panel according to claim 1, wherein the acoustic panel has a hexagonal shape.

* * * * *